US006683538B1

(12) United States Patent
Wilkes, Jr.

(10) Patent No.: US 6,683,538 B1
(45) Date of Patent: Jan. 27, 2004

(54) POSITION DEPENDENT MESSAGING SYSTEM

(76) Inventor: Robert D Wilkes, Jr., 123 Dolphin Ave., Galveston, TX (US) 77550

( * ) Notice: Subject to any disclaimer, the term of this patent is extended or adjusted under 35 U.S.C. 154(b) by 0 days.

(21) Appl. No.: 09/384,316

(22) Filed: Aug. 27, 1999

Related U.S. Application Data

(60) Provisional application No. 60/098,389, filed on Aug. 29, 1998.

(51) Int. Cl.[7] ..... G08G 1/16

(52) U.S. Cl. ..... 340/903; 340/901; 340/902; 340/905; 340/539.1; 340/539.13; 340/988; 340/989; 340/991

(58) Field of Search ..... 340/901, 902, 340/903, 904, 905, 539.1, 991, 988, 989, 992, 993, 995.25, 539.13

(56) References Cited

U.S. PATENT DOCUMENTS 5,983,161 A * 11/1999 Lemelson et al. ..... 701/301
6,014,090 A * 1/2000 Rosen et al. ..... 340/905

* cited by examiner

*Primary Examiner*—Daryl Pope

(57) ABSTRACT

A messaging system is disclosed, delivery of messages being dependent upon the location of the recipient, the number of recipients being unlimited. The message transmitter may be fixed or mobile. The recipient may be either fixed or mobile, but must have knowledge of its own position. The transmitter broadcasts in radio frequencies (or other convenient medium) three pieces of information per message: a location, a trigger distance, and the message. The recipient, knowing its own position, calculates the actual distance to each location being broadcast. If the actual distance is less than the trigger distance, then the message is displayed to the recipient. In this manner, only messages that are relevant to the recipients' position are displayed, and messages relevant to other positions are ignored.

12 Claims, 3 Drawing Sheets

9

| ... | LOCATION A | TRIGGER α | MESSAGE A | LOCATION B | TRIGGER β | MESSAGE B | ... |
|---|---|---|---|---|---|---|---|

9

| ... | LOCATION A | TRIGGER α | MESSAGE A | LOCATION B | TRIGGER β | MESSAGE B | ... |
|---|---|---|---|---|---|---|---|

POSITION DEPENDENT MESSAGING SYSTEM

CROSS-REFERENCE TO RELATED APPLICATIONS

This application claims the benefit of U.S. Provisional Application No. 60/098,389, filed Aug. 29, 1998.

STATEMENT REGARDING FEDERALLY SPONSORED RESEARCH OR DEVELOPMENT

Not Applicable

BACKGROUND

1. Field of Invention

This invention relates to an information distribution system which delivers information to recipients only when the recipient is in a particular location 2. Description of Prior Art Positional awareness due to the advent of GPS and other satellite based location systems is becoming less and less costly. Vehicles and persons using small receivers have knowledge of their geographical position to greater and greater accuracy. Using this knowledge, and delivering information (messages) relevant to location is the purpose of this invention.

In many instances, the usefulness of information is location dependent. This is manifested in the "sales" sign in the window of a store, or the siren of the tire engine. The information delivered may be text, audio, or graphical in nature, or any combination thereof. The key element is the need for the information only in certain geographical locations.

Other inventions propose to deliver messages to distinct places (Buss et al, U.S. Pat. No. 5,539,395). They rely however, on the sub-division of the area of coverage into a predefined grid of smaller areas. The message delivery is effected only within the pre-defined grid element. In order to deliver messages to a larger area, many grid locations must be transmitted, significantly encumbering the transmitter. It is the purpose of this invention to allow a variable area of coverage for each message receiving location, with a greatly reduced amount of transmitted information.

Still other inventions have proposed to avoid collisions amongst a collection of vehicles by having each broadcast its location, and simultaneously receive all others (U.S. Pat. No. 4,835,537 Manion, U.S. Pat. No. 5,068,654 Husher, U.S. Pat. No. 5,153,863 Fraughton, U.S. Pat. No. 5,210,534 Janex, U.S. Pat. No. 5,506,587 Lans). Some of these systems encode messages with the position information that they broadcast (U.S. Pat. No. 5,574,469 Hsu, U.S. Pat. No. 5,450,329 Tanner). Such systems become increasingly complex and cumbersome as the number of vehicles increase. The number of frequencies allocated to these systems must be large, or complex timing algorithms must be employed to avoid having two vehicles transmitting at one time on the same frequency. These types of systems are therefore limited to just a small number of participants. It is the purpose of this invention to allow an unlimited number of participants.

The problem of transmitting information (messages) over a local area has been approached through the use of low power transmissions, which make use of the fact that the signal strength diminishes with distance to achieve a local transmission of information. Lack of signal, or some signal strength threshold becomes the criteria for whether or not the receiver gets the message. The main and significant difference of this invention over the use of low power transmissions are:

1) Low power transmissions require a transmitter at each location. This invention can cover multiple geographic areas with a single transmitter. Additionally, this invention allows the transmitter to be located far from the location, especially useful if local electrical power is unavailable, the location is hazardous, or if the emission of signals from the location is undesirable.
2) Low power transmissions have a very vague boundary, which may vary due to many effects, such as atmospheric conditions, obstacles, or the orientation of the receiving antennae. This invention does not have any of these limitations, its boundary is constant and its precision is dependent only on the accuracy of the knowledge of one's location.

BRIEF SUMMARY OF THE INVENTION

A position dependent messaging system is disclosed, whereby information (messages) are received only if the message is pertinent to the geographic location of the recipient. Some uses of this invention are as follows:

Emergency vehicle collision avoidance. Cars are being built with greater and greater levels of sound insulation. As such it is increasingly difficult for sirens to be heard, increasing the burden on drivers, who must rely on spotting emergency vehicles more than ever. Accidents involving emergency vehicles themselves or between other vehicles which suddenly react to the presence of the emergency vehicle are common.

Automobile drivers using this invention will receive a warning when an ambulance, fire truck, or police car in an emergency situation approaches within a pre-determined distance. A direction and distance to the emergency vehicle within this distance may be displayed, given in audio format to the driver, or the information may be used to influence autonomous operation, turn off internal devices which may distract the driver, and the like.

Constrution Work Warning System

Workers on public roads are at risk from motorists, and motorists are confronted with unusual road conditions in construction zones. Typically, temporary signs are used to warn motorists of roadwork or construction. These signs are necessarily simplistic, and are commonly placed too close to the affected area for drivers to take corrective action.

Vehicles employing this invention would receive an additional warning from within their own vehicle, they can be provided with considerable detail on the nature and scope of the changes before they are encountered, and can be advised of alternate routes to avoid the area.

Traffic Alert/Dangerous Condition Warning

Driving hazards vary from the mundane traffic backup to unique events, such as accidents, hazardous material spills, obscuring effects such as smoke or dust across the road, and any number of other hazards. Currently, the main warning system motorists have is via radio reports, which are given from time to time. Information is also typically given for a wide region, and drivers must filter out the information that is relevant to them. Use of this invention would allow minute to minute update of road conditions, automatically filtered for each user of the invention. Furthermore, this service would be continuous, and would only be given to those drivers who are approaching an area of concern. Motorists will receive these alerts miles before the backup, allowing alternate routes to be taken.

High Speed Chase Alert/Road Closure System

High speed chases often result in accidents involving vehicles other than the pursuer and the pursued. Motorcades or the movement of large equipment often require police escort to close a section of road ahead of the primary vehicle. Road closure in these cases is a dynamic event, with the closed section of road actually moving.

Users of the invention will be notified to exit or modify their speed long before the need to do so becomes apparent, reducing risk to the users and reducing the workload of law enforcement officers.

Hazard Navigation

Moving though a mined or otherwise hazardous area is dependent on the knowledge of the safe corridors, which can vary from hour to hour.

Use of the invention would provide the directions for navigation through a mined or hazardous area through the use of known waypoints or specific directions, which will only be given at specific locations to authorized individuals located within the area. Encryption of this information, the dissemination of false information, and providing the information at only specific times are obvious variations which can be employed to ensure that passage by only authorized individuals is possible.

Regional Information Bulletin

Specific areas of danger can be posted without the use of signs, and they can be changed over a wide area from moment to moment. Such information can be updated and distributed much more quickly than a map, and can indicate areas of military concern (regions of sniper activity, contaminated areas, locations about to be attacked, or the location of friendly forces) or general hazards such as the potablility of a water source, the location or expected path of a tornado, or other time- or location-dependent information.

Guided Tour

Individuals touring National Parks, Fairs, Museums, or other large public displays typically gather information on their surroundings by written material, either at the site, or in booklets. At temporary sites, sites at which the posting and maintenance of signs is prohibitive, or during short duration events the information is most often given verbally by employees, which may be overly expensive or impossible in some cases.

Use of the invention would allow a large area to be 'documented' and updated quickly at any location. It would allow special events to have the same level of attention as established sights. For example, in a National Park, the blooming of a particular plant, the presence of a particular species, or other events which may occur for only a few days or for only a few hours a day can be 'posted' just as well as geographic features, which themselves may only need a seasonal update.

Orienteering Aid

Orienteering involves the use of map and compass and the following of an unmarked cross country route in a race. Participants begin one at a time, and must reach a series of waypoints marked on a map. The passage of each contestant must be documented at each waypoint. The participant who completes the course in the least amount of time is declared the winner.

With the disclosed invention, no prior physical set up of the course waypoints, documentation of waypoint arrival, or map preparation need be made. Each successive waypoint is presented to the participant at the prior waypoint via a hand held display. In this way the actual extent of the course will not be known to the participants until it is completed, adding a new dimension to the event.

Advertising

Advertising the availability of goods or services is perhaps most effective near the location of the product.

Use of the invention will allow passers by to receive messages advertising specials, or simply to make potential customers aware of the proximity of the product. Such advertising capability can be combined with any of the other aspects of the system disclosed above to allow it to subsidize the service. In such cases, an order of precedence will be beneficial. Advertising would be subordinate to safety messages, for example, and would not be displayed if a safety message is relevant to the user in the same or overlapping location.

The above list is illustrative of the types of service the invention can provide, and is by no means complete. Different types of service using the same or similar patterns are considered obvious variants. Most importantly, users of the invention will enjoy the services offered with complete anonymity. The signals used to overlay the message and position information over a given region are the only transmissions needed. The unlimited number of users within this region need only employ a receiver, in very much the same way as a radio station functions. Information is customized for each user based on the users' position, and other criteria that the user may select. No transmission is needed from the users (receivers) to receive the full benefit of the service.

DETAILED DESCRIPTION OF THE INVENTION

This invention intends to provide a system for information (message) delivery to an unlimited number of receivers, for information that varies with time or location. It is furthermore the intention that this information be provided only to those locations where it is relevant. In the context of this disclosure, a 'message' shall consist of any type of information which the recipient may need, presented in any format which is convenient, and may be in audio, visual or other form. Furthermore, a "transmitter" as used in this patent, indicates a radio frequency or other convenient frequency band transmission that covers a broad region. Such a transmitter may be an actual fixed tower, a satellite, a moving vehicle mounted transmitter, or even a loitering aircraft. The key element is that the transmitter need not know or reveal its own location, it merely delivers information relevant to other locations.

Figure 1:
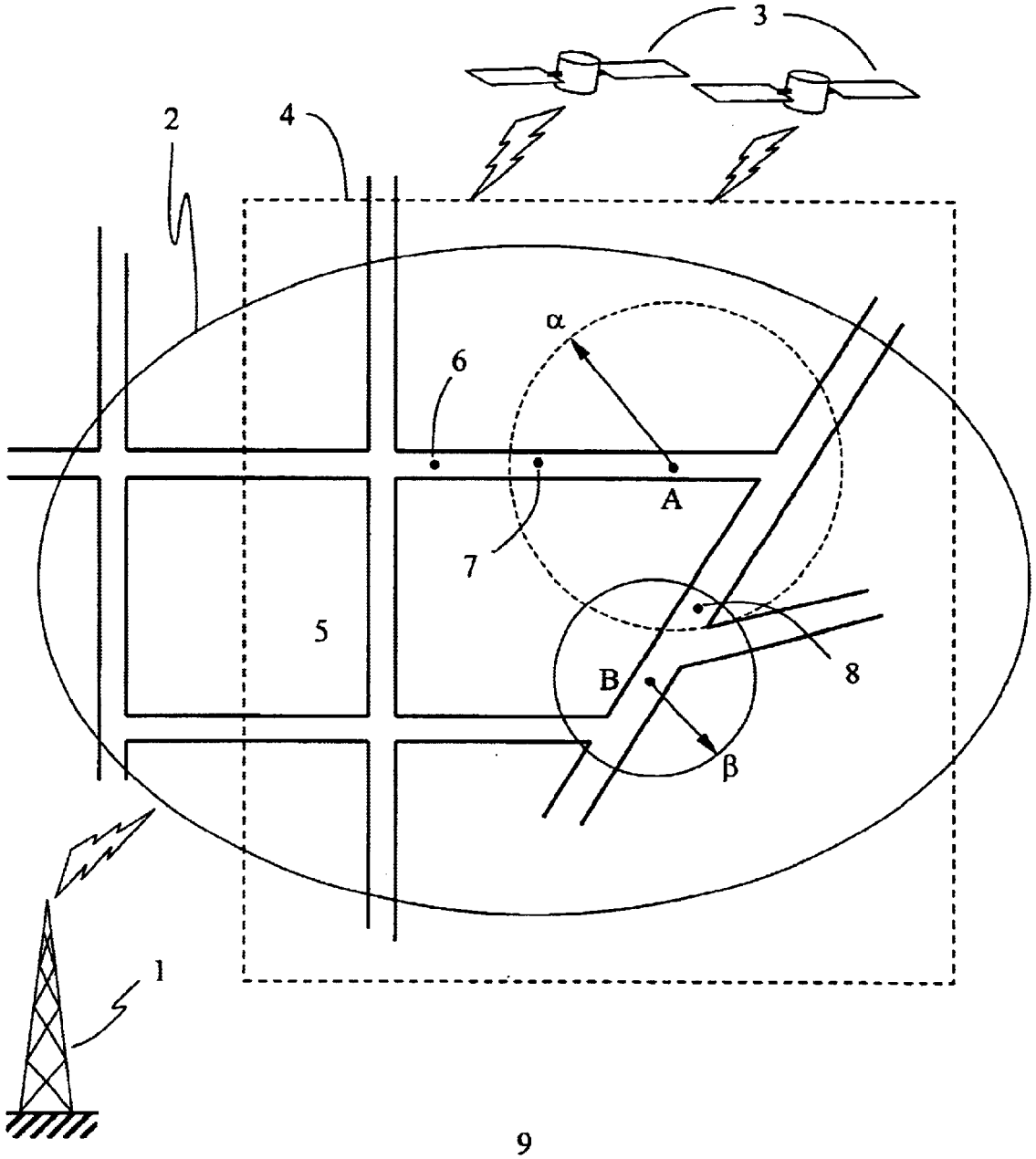
FIG. 1 shows a region served with a fixed transmitter and position determining system, showing several and variable sized message delivery areas within the region being served.

In the preferred embodiment, the invention has 4 main modes of deployment, which may operate concurrently with each other:

1) Fixed transmitter, moving receivers
2) Moving transmitter, moving receivers
3) Moving transmitter, fixed receivers
4) Fixed transmitter, fixed receivers FIG. 1 illustrates the fixed transmitter embodiments, with either moving or stationary receivers. FIG. 1 shows a region of service 2, served by a fixed transmitter 1. An overlapping region 4 is served by a positional location determining means 3. The area covered by both region 2 and region 4 is the area served by the invention 5. The elements in the broadcast 9 are as follows: a location 10, a trigger distance 11, and a message 12. These elements are broadcast serially, one set for each message. The second message 15, is preceded by it's corresponding location of delivery 13, and it's trigger distance 14 The trigger distance defines the circular area $\alpha$ about the location 'A' within which the message will be displayed. Receivers 6, 7 & 8 will all receive the messages, but if they do not lie within the trigger distance of any of the message locations, the messages are not displayed. Thusly, receiver 6 will display no messages, receiver 7 will display the message 'A', and receiver 8 will display the message 'A' as well as the message 'B'.

Figure 2:
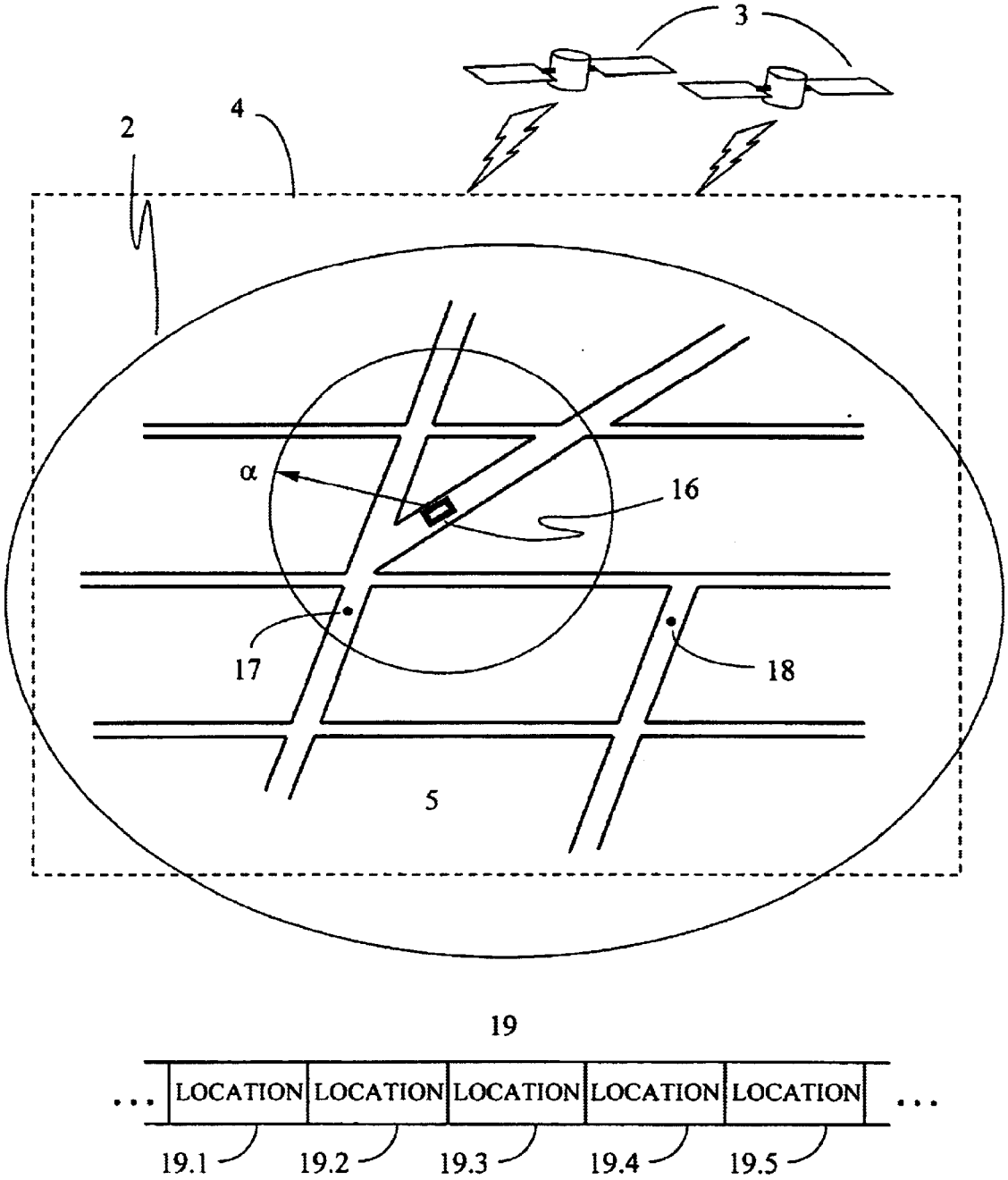
FIG. 2 shows a region served by a mobile transmitter and a position determining system, with the mobile transmitter location as the center of a message delivery area.

FIG. 2 illustrates the moving transmitter embodiments, with either moving or stationary receivers in an area of service 5. A moving transmitter 16 broadcasts a signal 19 to a region of coverage 2. An overlapping region 4 is served by a positional location determining means 3. The area covered by both region 2 and region 4 is the area served by the invention 5. In the preferred embodiment, moving transmitter 16 is an emergency vehicle with sirens on, which will not be obeying traffic rules due to an emergency situation. The elements in the broadcast 19 are, in the simplest embodiment, a repetition of the location of the transmitter 16; 19.1, 19.2, 19.3, 19.4 & 19.5. The location given by 19.1 will be the same as that given by 19.2 if the transmitter 16 is stationary or moving slowly. The location given by 19.3 will be different from that given by 19.4 or 19.5 if the transmitter has moved between the time of the two broadcasts. Additional elements may be added to transmission 19, such as an indication of what type of vehicle, or the nature of the emergency. Such information may be broadcast from time to time, or after each location. In this preferred embodiment, the trigger distance and information is predetermined. Being within the pre-defined trigger distance would cause users of the invention to be warned of the approach of an emergency vehicle. Display of a distance and direction to the emergency vehicle is the preferred message, although a simple light or sound could be used.

Figure 3:
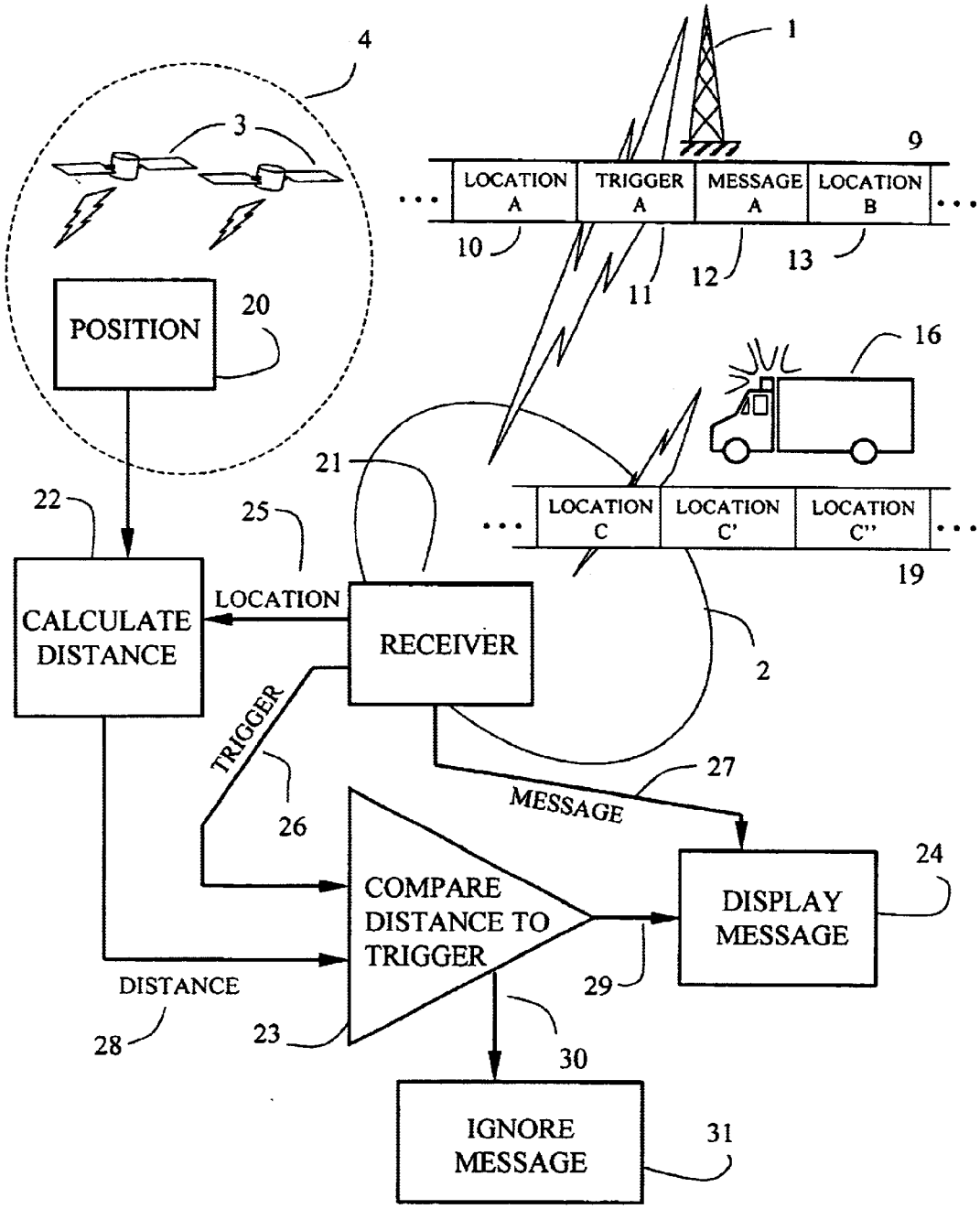
FIG. 3 shows a block diagram of the device in accordance with the preferred embodiment.

FIG. 3 illustrates the functioning of the device. One or more moving transmitters 16 each broadcasts a signal 19 and or one or more fixed transmitters I each broadcasts a signal 9, received by receiver module 21. The device is within region 4, which is served by a positional location determining means 3. A module 20 determines the position of the device from the, location determining means 3, and passes this information to module 22. The receiver module 21 breaks up the signal 9 into it's component parts, location 10, trigger distance 11, and message 12. Location 10 is passed onto module 22, where the difference in the location 10 and the position of the device is calculated. The result or this calculation is the distance 28 to the location 10. Receiver module 21 furnishes the trigger distance 26 for comparison to distance 28 in comparator module 23. If distance 28 is less than or equal to trigger distance 26, then the corresponding message 27 is allowed to be displayed by display module 24. If distance 28 is greater than the trigger distance 26, the message 27 is inhibited from being displayed, and is therefore ignored.

In the preferred embodiment, these modules are not distinct hardware elements, but are integrated functions of a single processor based device, modules 22 and 23 are simply calculations performed by the processor.

In the preferred embodiment, a global positioning type system is in place and is providing positional information, however, any means of knowing one's position may be used. The accuracy required for the positional information will depend on the application. For example, minefield navigation may require that one's position be known to meters, whereas the emergency vehicle warning system would only require positional knowledge within tens or hundreds of meters, as long as message display in this embodiment begins at even greater distances (a kilometer, for example).

In the preferred embodiment, several modes as described above may operate simultaneously, such as the Emergency Vehicle Warning System and the Traffic Alert system. The Emergency Vehicle Collision Avoidance System would employ mobile transmitters on each ambulance. Each ambulance would know its own position, and broadcast that location when the siren was turned on. The ambulance location being broadcast would be updated continuously as the vehicle moves. Cars (receivers) would receive the signal miles away, but only those within, say, a kilometer would be notified by the invention. The distance and direction to the ambulance can then be displayed to the driver (display of the direction to the ambulance would require that the receiving vehicle also knew which way it was pointing).

The Traffic Alert system would employ a centrally located fixed transmitter, and vehicles (receivers) moving within its range would be receiving road condition information for the entire area. Vehicles which enter a defined message area (within the trigger distance of a specific location) will display the message. The message area can be a single location or a multitude of locations each with its own trigger distance, spaced so as to define any geometric area needed for message delivery.

The fixed receiver condition would apply, for example, to both of the above cases whenever any vehicle is stopped. In these cases, the only signals that it would display would be those that changed with time, such as when an emergency vehicle passes close by.

Different components of a combined system may use different frequencies to avoid conflict. For example, a fixed transmitter serving a region for Traffic Alert may be on a different frequency than ambulances, fire trucks, and other mobile transmitters. Because the number of transmitters is low, and the information being transmitted by mobile transmitters is simple, mobile transmitters may employ various schemes for sharing frequency or simply use distinct frequencies.

Frequency sharing schemes may be employed such as by coordinating the timing of transmissions so that they do not overlap. This is facilitated by the use of the positional locating system's signal as a time-coordination device, and staggering broadcasts throughout a pre-defined time interval. For example, ambulance #1 uses the time interval from 0 to 0.01 sec, ambulance #2 uses 0.02 to 0.03, etc. . . . All the vehicles using the system are synchronized because they all use the same satellite based signals to determine their own position.

What I claim is:

1. A message delivery system consisting of transmitters, receivers, and a position location means, said transmitters broadcasting a signal containing messages with corresponding locations at which said messages are to be delivered, said receivers discriminating in the delivery of said messages in the following manner:

a) said receivers determine their own position via said position location means b) said transmitters broadcast said signal containing said messages along with said corresponding locations c) said receivers deconstruct said signal, and determine their proximity to each of said locations via a calculation means d) said receivers deliver said messages if the proximity of said receiver to any of said corresponding locations is less than or equal to a predetermined distance said message being information in audio, visual, or other convenient form, and said transmitters are not co-located with said receivers.

2. The invention as described in claim 1, wherein a trigger distance is transmitted along with said location and said message, said receiver comparing its position against said location via said calculation means, delivering said message only if said comparison yields a value less than or equal to said trigger distance.

3. The invention as described in claim 1, wherein a device specific address is also broadcast, said receivers compare their address with said device specific address, ignoring said message if said address does not correspond to said device specific address.

4. A message delivery system consisting of transmitters, receivers, and a position location means, said transmitters broadcasting a signal containing messages and the current location of said transmitter, said receivers discriminating in the delivery of said messages in the following manner:

a) said receivers determine their own position via said position location means b) said transmitters broadcast said signal containing said messages along with said location of said transmitter c) said receivers deconstruct said signal, and determine their proximity to said location via a calculation means d) said receivers deliver said messages if the proximity of said receiver to any of said corresponding locations is less than or equal to a predetermined distance said message being information in audio, visual, or other convenient form, and said transmitters are not co-located with said receivers.

5. The invention as described in claim 4, wherein said message is determined by the receiver based on information derived from the position of said transmitter and said receiver, such as bearing, distance, closure speed and the like.

6. The invention as described in claim 4, wherein said transmitter broadcasts said message, containing information such as the type of emergency vehicle, the emergency vehicle speed, or any other information useful to said receiver.

7. A position dependent message delivery system employing a fixed transmitter with a defined area of coverage, said transmitter producing a signal with the following content:

a) geographical location b) discrimination criteria, such as threshold distance, heading, speed, message content identifier, or the like c) a message corresponding to said location and said discrimination criteria said signal continuously repeated with one or more distinct locations, associated discrimination criteria, and messages, in sequence, said message delivery system also including one or more receivers, free to move about said area of coverage anonymously, said receivers determine their position via a position location means, said receivers compare said geographical location in said signal with said position, calculate the distance between said geographical location and said position via a calculation means, and only deliver said message if said distance is less than said threshold distance.

8. The invention as described in claim 7, wherein said discrimination criteria are additionally compared with information determined by or furnished to said receivers, to further restrict the number of said messages delivered.

9. A position dependent message delivery system employing a mobile transmitter and a first position location means, said transmitter producing a signal with the following content:

a) the current location of said transmitter, as determined by said first position location means said signal continuously repeated, said message delivery system also including one or more receivers, free to move about anonymously, said receivers determine their position via a second position location means, said receivers compare said current location in said signal with said position, and only deliver a pre-determined message if said current location is sufficiently close to said position.

10. The invention as described in claim 9, wherein said signal also includes the following elements:

b) a message said receivers compare said current location in said signal with said position, and only deliver said message if said current location is sufficiently close to said position.

11. The invention as described in claim 10, wherein said signal also includes the following elements:

c) a threshold distance said receivers determine the distance from said current location to said position via a calculation means, and only deliver said message if said distance is less than said threshold distance.

12. The invention as described in claim 11, wherein said signal also includes the following elements:

d) discrimination criteria, such as heading, speed, message content identifier, or the like said receivers additionally compare said discrimination criteria to other known information, and only deliver said message if said discrimination criteria are met.

* * * * *